US012709448B2

(12) United States Patent
Braglia

(10) Patent No.: US 12,709,448 B2
(45) Date of Patent: Aug. 18, 2026

(54) DUAL COMPARTMENT WIPE DISPENSER

(71) Applicant: Michael Joseph Braglia, Venice, FL (US)

(72) Inventor: Michael Joseph Braglia, Venice, FL (US)

(73) Assignee: DUAL WIPES SOLUTIONS LLC, Venice, FL (US)

( * ) Notice: Subject to any disclaimer, the term of this patent is extended or adjusted under 35 U.S.C. 154(b) by 214 days.

(21) Appl. No.: 18/435,770

(22) Filed: Feb. 7, 2024

(65) Prior Publication Data

US 2025/0091778 A1 Mar. 20, 2025

Related U.S. Application Data

(60) Provisional application No. 63/538,582, filed on Sep. 15, 2023.

(51) Int. Cl.

| | |
|---|---|
| ***B65D 51/28*** | (2006.01) |
| ***B65D 53/06*** | (2006.01) |
| ***B65D 83/08*** | (2006.01) |

(52) U.S. Cl.

CPC ..... *B65D 51/28* (2013.01); *B65D 53/06* (2013.01); *B65D 83/08* (2013.01); *B65D 2583/082* (2013.01)

(58) Field of Classification Search

CPC .... B65D 51/28; B65D 83/08; B65D 2583/08; B65D 2583/082; A47K 2010/3266; A47K 10/20; A47K 10/24; A47K 10/421

See application file for complete search history.

(56) References Cited

U.S. PATENT DOCUMENTS

| | | | |
|---|---|---|---|
| 4,205,802 | A | 6/1980 | Economakis |
| 4,478,354 | A | 10/1984 | Notheis |
| 5,957,325 | A | 9/1999 | Montanez |
| D414,637 | S | 10/1999 | Amundson et al. |
| D443,451 | S | 6/2001 | Buck et al. |

(Continued)

FOREIGN PATENT DOCUMENTS

| | | | | |
|---|---|---|---|---|
| EP | 4434387 A2 | * | 9/2024 | ..... A47K 10/421 |
| KR | 20190059373 A | * | 5/2019 | ..... B65D 83/0835 |

(Continued)

*Primary Examiner* — Michael Mccullough

(74) *Attorney, Agent, or Firm* — Whiteford, Taylor & Preston, LLP; Jeffrey Schell

(57) ABSTRACT

The present invention relates to a multi-compartment wipe dispenser with a one-handed operation mechanism, designed to enhance the convenience and efficiency of storing and dispensing different types of wipes. The dispenser features a dual-compartment system that allows for the separation and preservation of distinct wipe formulations, such as baby wipes and personal care wipes, in a single portable unit. A mechanical opening mechanism enables users to access the wipes with a single hand, while a robust sealing system ensures the wipes remain moist and uncontaminated. The dispenser is constructed with materials free from PVC, BPA, and phthalates, and includes a strap for easy attachment to various items, making it ideal for on-the-go use. This innovative dispenser addresses the need for a compact, versatile, and hygienic solution to manage personal care wipes, providing a significant advancement in the field of wipe dispensers.

7 Claims, 5 Drawing Sheets

(56) References Cited

U.S. PATENT DOCUMENTS 6,439,386 B1 8/2002 Sauer et al.
D466,807 S 12/2002 Buck et al.
D471,440 S 3/2003 Sams et al.
D474,688 S * 5/2003 Litts ..... D9/432
D498,623 S 11/2004 Sams et al.
D629,309 S 12/2010 Stewart
D630,939 S 1/2011 Peters et al.
D656,021 S 3/2012 Dunn et al.
D663,632 S 7/2012 Peters et al.
D666,488 S 9/2012 Frias
8,418,879 B2 4/2013 Sherman et al.
8,540,117 B2 * 9/2013 Andrews ..... B65D 83/0805 221/34
8,844,745 B2 9/2014 Peters et al.
9,527,624 B1 12/2016 Phipps et al.
D804,218 S 12/2017 Worden et al.
D806,571 S 1/2018 Umholtz et al.
11,987,439 B2 * 5/2024 Frazier ..... B65D 43/169
2001/0019064 A1 * 9/2001 Jacques ..... A47K 10/421 221/63
2001/0035416 A1 * 11/2001 Dodson ..... A47K 10/421 220/826
2002/0079322 A1 6/2002 Wilkes et al.
2003/0159403 A1 * 8/2003 Verespej ..... B65D 83/0805 53/471
2003/0178436 A1 * 9/2003 Ashford ..... A47K 10/421 221/33
2004/0099679 A1 5/2004 Welchel et al.
2005/0029280 A1 * 2/2005 Hayes ..... B65D 83/08 221/34
2005/0051568 A1 * 3/2005 Young ..... B65D 81/32 221/34
2008/0179332 A1 * 7/2008 Sanders ..... B65D 47/0842 220/524
2013/0174865 A1 * 7/2013 Bennett ..... A47K 5/12 132/314
2020/0262638 A1 * 8/2020 Lang ..... B65D 83/0894
2020/0385200 A1 * 12/2020 Dunis ..... B65D 83/0805
2021/0361127 A1 * 11/2021 Wang ..... B65D 83/0811
2022/0279991 A1 * 9/2022 Simmons ..... A47K 10/46

FOREIGN PATENT DOCUMENTS

KR 20210078100 A * 6/2021 ..... B65D 83/0805
KR 20220137828 A * 10/2022 ..... B65D 75/38
KR 20230134342 A * 9/2023 ..... A47K 10/421
WO WO-2020249411 A1 * 12/2020 ..... B65D 83/0805
WO WO-2023153904 A2 * 8/2023 ..... A47K 10/421

* cited by examiner

DUAL COMPARTMENT WIPE DISPENSER

This application claims the benefit of U.S. Provisional Patent Application 63/538,582 filed on Sep. 15, 2023, which is hereby incorporated by reference in its entirety.

BACKGROUND OF THE INVENTION

Field of the Invention

The present invention relates generally to dispensing containers for wipes and, more specifically, to a multi-compartment dispenser designed for storing and dispensing different types of wipes, such as baby wipes, hand and face wipes, wet wipes, water wipes, and other personal care wipes, with enhanced features for ease of use, portability, and preservation of the wipes.

Description of the Related Art

Wipe dispensers are commonly used for dispensing moistened towelettes for personal care, hygiene, or cleaning purposes. Traditional wipe dispensers often cater to a single type of wipe and are designed with a focus on functionality for that specific use. However, several issues have been identified with existing wipe dispensers that limit their convenience and effectiveness.

In addition to the functional limitations of existing dispensers, portability remains a significant concern for consumers, particularly for caregivers who are often on the move. Traditional dispensers are typically designed for stationary use within homes or public facilities, and their bulkiness or inconvenient attachment mechanisms make them unsuitable for on-the-go scenarios. For instance, caregivers may find it challenging to access wipes when outside, such as during walks with a stroller, shopping trips, or while traveling in a vehicle. The need to carry separate containers for different types of wipes further compounds the issue, leading to increased baggage and reduced convenience. Moreover, the existing dispensers do not adequately address the need for a secure and accessible attachment to various objects like strollers, shopping carts, or car interiors, which is essential for ensuring the wipes are readily available when needed. The lack of a compact, versatile, and easily transportable wipe dispensing system that can be readily attached to and detached from various supports without the risk of the wipes drying out or becoming contaminated is a gap in the market that has yet to be filled. This gap highlights the need for an innovative solution that combines portability with the functionality of providing multiple types of wipes in a single dispenser, ensuring that the wipes remain fresh, moist, and hygienic regardless of the setting or circumstances.

One prevalent issue is the difficulty in opening the dispensers, especially with one hand, which is a common necessity for caregivers or individuals engaged in multitasking. Many dispensers require two hands to open or have latches that are cumbersome to operate. Attempts to create one-touch dispensing systems have been made, such as those described in U.S. Pat. No. 8,418,879B2, but these systems often leave the contents vulnerable to drying out due to exposure to air through holes or gaps in the design.

Furthermore, the use of wipes for different purposes, such as cleaning a baby's face or a pacifier, raises concerns about the chemicals and ingredients used in the wipes. Products like hand and face wipes may contain substances that are not suitable for sensitive skin or for use around a baby's mouth, as indicated by the presence of potentially harsh chemicals in the wipes found in the market.

Existing solutions, such as the multiple roll toilet tissue dispenser described in U.S. Pat. No. 4,205,802A, the melt-blown microfiber wiper package in U.S. Pat. No. 4,478,354A, and the apparatus for storing and dispensing disposable diapers in U.S. Pat. No. 5,957,325A, provide means for storing and dispensing wipes or related products. However, these references do not address the need for a dispenser that can accommodate different types of wipes in a single, convenient, and portable unit while ensuring that the wipes remain moist and free from contamination.

Additionally, the dispenser for wet and dry interfolded tissue in US20040099679A1 discloses a housing for simultaneously dispensing premoistened and dry tissue sheets. While this reference suggests the utility of having access to different types of wipes, it does not provide a solution that is specifically tailored to the needs of caregivers who require a portable, easy-to-use dispenser capable of preventing cross-contamination and maintaining the moisture of the wipes.

There is a need for an improved wipe dispenser that addresses the aforementioned issues by providing a user-friendly, one-handed operation, preventing the drying out of wipes, accommodating different types of wipes, and ensuring the safety and suitability of the wipes for various uses, including those involving infants. Such a dispenser should also be portable, adaptable to different environments, and capable of using standard-sized wipes with various folding styles.

SUMMARY OF THE INVENTION

The present invention provides a novel multi-compartment wipe dispenser designed to address the shortcomings of existing dispensers by offering enhanced portability, ease of use, and the ability to maintain the moisture and integrity of different types of wipes. This innovative dispenser is characterized by its one-handed operation mechanism, dual-compartment design for housing distinct wipe formulations, and a robust sealing system that prevents the wipes from drying out and cross-contamination.

A key feature of the invention is the mechanical opening mechanism, which allows users to access the wipes with a single hand by pressing a button. This feature is particularly advantageous for caregivers who may be holding a child or performing other tasks simultaneously. The dispenser's opening mechanism is further enhanced by a silicone piece with knobs that create a substantially airtight seal when closed, preserving the moisture of the wipes without the need for additional, cumbersome closures.

The dispenser is uniquely designed with two separate compartments, each capable of storing a different type of wipe, such as a soap wipe and a water wipe. This dual-compartment system enables users to choose the appropriate wipe for different needs, such as cleaning and then rinsing a baby's face, without the risk of using the wrong product. The compartments are designed to be compatible with standard wipe sizes and fold types, including Z-fold, interfold, and crossfold, providing versatility and compatibility with existing wipe products.

Portability is a cornerstone of the invention, with a strap included for easy attachment to various items such as baby carriers, strollers, shopping carts, wheelchairs and even within the confined space of a car's glove compartment. The compact design ensures that the dispenser can be transported effortlessly and used in a variety of settings.

The invention also addresses environmental and health concerns by utilizing materials that are free from PVC, BPA, and phthalates. The choice of materials like silicone and rubber for the sealing gasket and o-ring, and the option for an injection-molded construction, reflect a commitment to safety and durability.

In summary, the invention represents a significant advancement in the field of wipe dispensers by combining the convenience of one-handed operation, the functionality of dual compartments for different wipe types, the assurance of maintaining wipe quality through an airtight seal, and the adaptability for on-the-go use. This dispenser is poised to become an indispensable accessory for anyone in need of a practical and hygienic solution for managing personal care wipes.

DETAILED DESCRIPTION OF THE INVENTION

The preferred embodiment is a meticulously designed multi-compartment wipe dispenser that offers an innovative solution to the storage and dispensing of moist towelettes.

The preferred embodiment is characterized by its user-friendly construction, which includes a lid 3000, an upper portion with two apertures 3050, a main body featuring two sealable compartments, a lid door 3200 comprising o-ring gaskets 3250 for an airtight seal, and a tethering mechanism 1001 for carrying convenience. Each aspect of the preferred embodiment is crafted to enhance the user experience while maintaining the integrity and moisture of the towelettes.

Figure 1A:
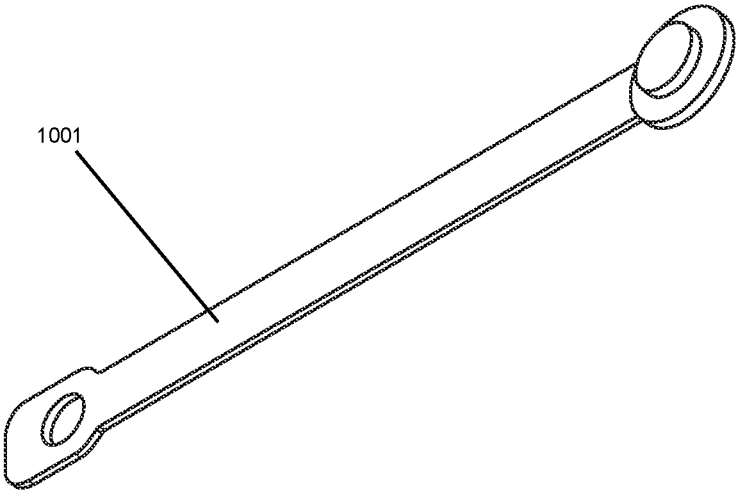
FIG. 1*a* depicts a perspective view of an embodiment of a tethering mechanism.
Figure 1B:
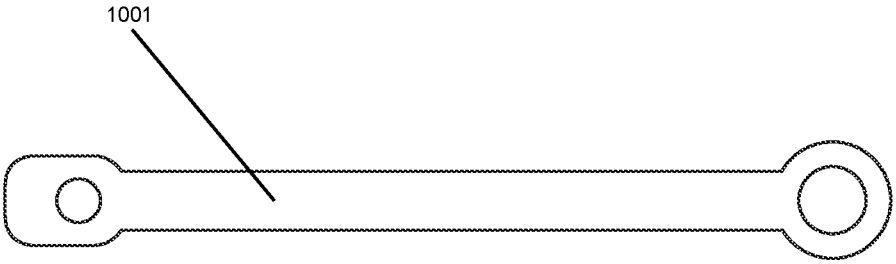
FIG. 1*b* depicts a side view of an embodiment of a tethering mechanism.
Figure 2:
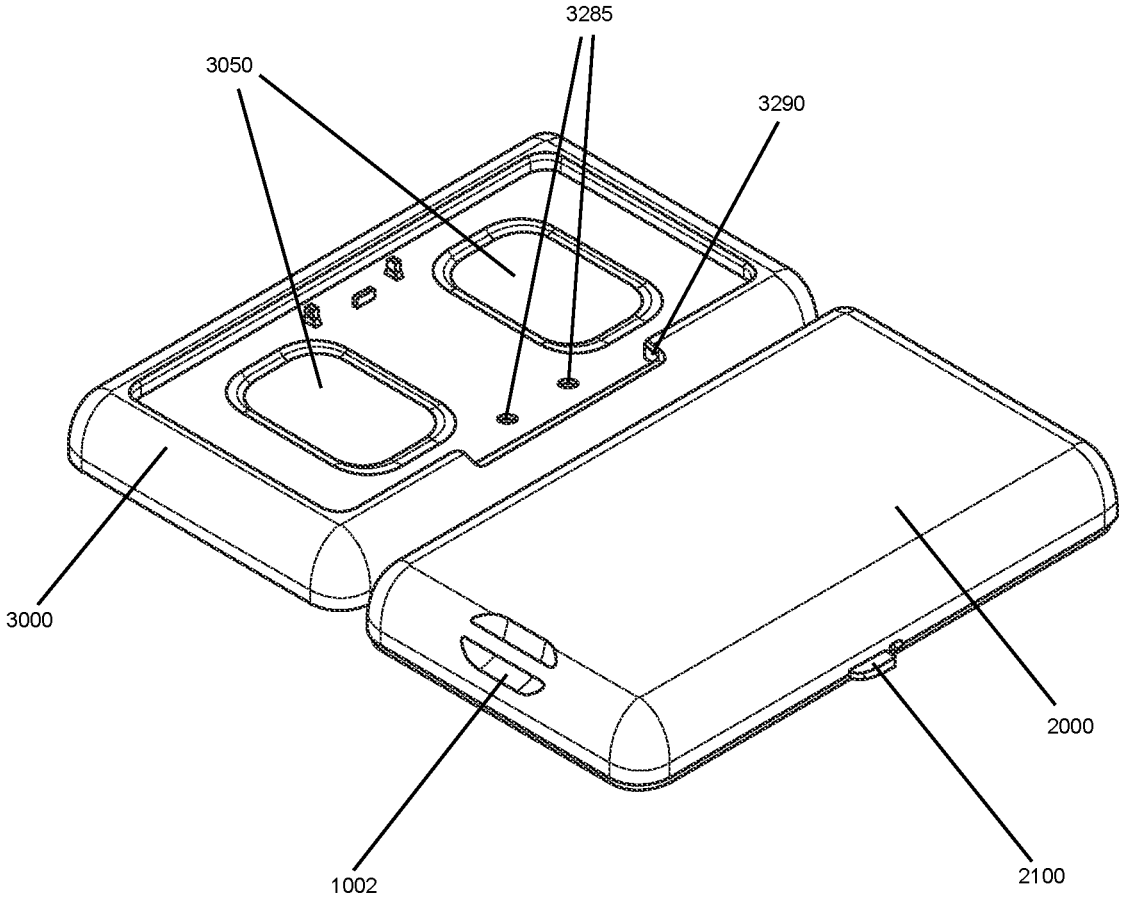
FIG. 2 depicts a perspective view of an embodiment of the wipe dispenser without the lid door.

The lid 3000 of the dispenser in its preferred embodiment is designed to be easily maneuverable, allowing for ease of access to the towelettes contained within each of the two sealable compartments. In the preferred embodiment, the upper portion of the dispenser comprises the lid 3000 and further comprises two distinct apertures 3050 as depicted in FIG. 2. Each aperture 3050 leads to a separate airtight compartment within the main body 2000 of the dispenser. The apertures 3050 are sized to comfortably allow a portion of a person's hand or fingers to pass through, facilitating the retrieval of a towelette without introducing excessive air that could dry out the remaining contents.

In association with the preferred embodiment, the lid 3000 of the dispenser incorporates aspects intended to facilitate ease of access while preserving the internal conditions within the interior volume of the dispenser necessary for maintaining the towelettes' moisture. Each aperture 3050 within the lid 3000 is generally ovular in shape, with dimensions carefully considered to optimize functionality and user experience in the preferred embodiment. The height of each aperture 3050 is approximately 2-3 inches, and the width is approximately 1.5-2.5 inches. These dimensions correspond to the size needed for an individual moist towelette to pass through without difficulty. This configuration allows users to retrieve a single towelette at a time while ensuring that the remaining towelettes—and the packaging that contains them—are securely retained within the volume of the container in part by the inferior aspect of the lid 3000. The ovular shape of the apertures 3050 is not only aesthetically pleasing but also practical, as it minimizes the potential for snagging or tearing of the towelettes as they are dispensed. In association with the preferred embodiment, the sizing of each of the apertures 3050 plays a pivotal role in the dispenser's functionality, striking a balance between ease of access to the towelettes and the necessity of maintaining an airtight environment within each of the compartments to prevent the towelettes from drying out.

In the preferred embodiment of the invention, the lid 3000, along with most of the other primary components of the dispenser, is constructed from polypropylene. Polypropylene is renowned for its durability, resistance to fatigue, and its ability to maintain its shape after repeated use, and also appreciated for its chemical resistance and low moisture absorption, which is essential for a dispenser that is opened and closed frequently and designed to retain wipes in some circumstances that contain water and soaps. Additionally, polypropylene is resistant to a wide variety of chemical solvents, bases, and acids, making it an ideal material for a product that may be exposed to various cleaning agents or sanitizing wipes. Its low moisture absorption rate ensures that the lid 3000 does not become compromised by the moist environment within the dispenser, further contributing to the longevity and reliability of the sealing mechanism.

The preferred embodiment of the multi-compartment wipe dispenser, particularly components such as the lid 3000 and main body 2000, is manufactured using the injection molding process, leveraging the material properties of polypropylene. Injection molding is chosen for its ability to produce complex shapes with high precision and repeatability, which is essential for the interlocking and sealing features of the dispenser. During manufacturing, molten polypropylene is injected into a precisely crafted mold that defines the shape of the lid 3000 and main body 2000, including the apertures 3050, gasket grooves, and tether anchoring point 1002. Once cooled, the components exhibit a high degree of dimensional stability and structural integrity, ensuring a snug fit and airtight seal when assembled. This process in association with embodiments of the invention allows for the mass production of the dispenser's components with consistent quality, contributing to the overall reliability and functionality of the finished product.

However, embodiments of the invention are not limited to polypropylene alone. Alternative materials that possess similar characteristics of durability, chemical resistance, and low moisture absorption could also be employed in the lid 3000 and the other aspects of the dispenser. For instance, high-density polyethylene (HDPE) is another viable option, offering a slightly different balance of strength and flexibility, which may be advantageous depending on the specific use case. Acrylonitrile butadiene styrene (ABS) plastic is another alternative, known for its toughness and impact resistance, which could be beneficial for a dispenser that is likely to be used in high-traffic or potentially rough environments. Polycarbonate could be used where greater transparency is desired, allowing users to see the contents of the dispenser without opening it. Each of these materials can be molded to the precise dimensions and tolerances required for the lid 3000 and its apertures 3050, ensuring that the dispenser functions as intended regardless of the chosen material.

Furthermore, in an alternative embodiment incorporating a priority of sustainability, biodegradable plastics or bio-based polymers could be considered as alternative materials in the construction of the dispenser to traditional plastics. These materials are designed to break down more quickly in the environment, reducing the long-term impact of the product on the planet. While the use of such materials may involve trade-offs in terms of durability or cost, they represent an important option for consumers and manufacturers who are committed to reducing their ecological footprint.

The main body 2000 of the dispenser is the structural core that houses the towelettes. In the preferred embodiment, it consists of two sealable compartments, each dimensioned to receive a standard package of moist towelettes. This design consideration ensures that the dispenser can accommodate a wide range of towelette brands and packaging sizes, offering versatility to the user. The compartments are engineered to maintain an airtight environment when sealed, preserving the moisture and efficacy of the towelettes for extended periods.

The main body 2000 of the dispenser, in its preferred embodiment, is designed with a superior aspect that seamlessly corresponds to the inferior aspect of the lid 3000, ensuring a precise and secure fit between the two components when closed together. This congruence is critical for maintaining the airtight seal that is essential for preserving the moisture of the towelettes contained within. The superior aspect of the main body 2000 is contoured to match the contours and dimensions of the lid's 3000 inferior aspect, allowing for a snug engagement that prevents any unintended openings or leakages of air when the lid 3000 is closed. This design consideration not only enhances the functional integrity of the dispenser but also contributes to its overall aesthetic appeal, presenting a cohesive and streamlined appearance.

Within the main body 2000, an interior wall plays a pivotal role in the dual-compartment functionality of the dispenser. This wall divides the interior space into two separate compartments, each dedicated to housing a different type of towelette. The wall extends from the base of the main body 2000 to the underside of the lid 3000, ensuring that the compartments are completely isolated from one another. This separation is crucial for preventing cross-contamination between the two types of towelettes, especially important when one compartment contains a cleaning agent or other substance that should not mix with the contents of the other compartment. In the preferred embodiment, the interior wall is also constructed from polypropylene, chosen for its rigidity and chemical resistance, which ensures that it remains unaffected by the moisture or any chemicals from the towelettes.

In the preferred embodiment, to facilitate the secure closure of the dispenser, the main body 2000 incorporates is a lid catch mechanism 2100 as depicted in FIG. 2, which is a feature of the main body 2000 designed to interact with a corresponding lid overhang 3100 incorporated within the lid 3000. The lid catch 2100 is strategically positioned to align with the lid overhang 3100 when the lid 3000 is brought down to close. This lid catch 2100 in an embodiment comprises a protruding element or a recessed area on the main body 2000 that is shaped to accommodate and engage with the lid overhang 3100 portion of the lid 3000.

Figure 4A:
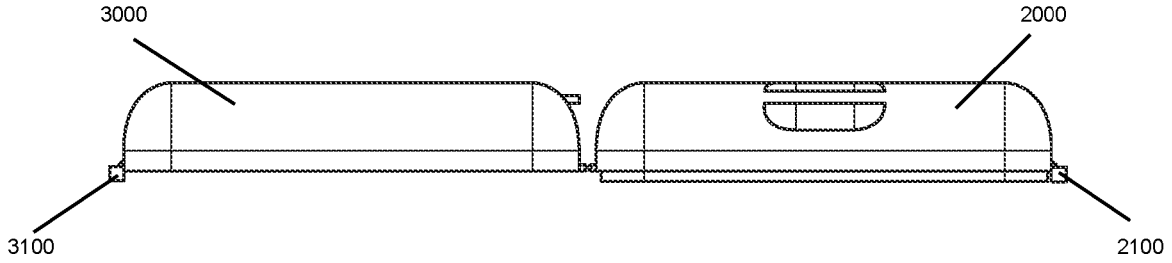
FIG. 4*a* depicts a side view of an embodiment of the wipe dispenser.

The lid overhang 3100 is a complementary feature that extends slightly beyond the edge of the lid 3000 as depicted in FIG. 4*a*, designed to interface with the lid catch 2100. When the lid 3000 is closed, the lid overhang 3100 is guided into position by the lid catch 2100, which may involve a slight downward pressure or a forward motion to ensure that the two components interlock. The interaction between the lid catch 2100 and the lid overhang 3100 results in a secure closure, preventing the lid 3000 from opening unintentionally and maintaining the airtight environment within the dispenser.

The design of the lid catch 2100 and lid overhang 3100 can vary depending on the desired level of security and ease of use. The preferred embodiment of the dispenser features a lid catch 2100 and lid overhang 3100 together forming a snap-fit mechanism, where the lid overhang 3100 includes a flexible tab that snaps into a corresponding slot or notch in the lid catch 2100. This provides a tactile and audible confirmation that the lid 3000 is securely closed. Another option is a hook-and-loop design, where the lid overhang 3100 has a hook-like structure that engages with a loop or catch on the main body 2000. This design is particularly useful for ensuring a tight closure without requiring excessive force to open the lid 3000.

For added security, in an embodiment the lid 3000 may also comprise a locking feature that requires a deliberate action to release the lid door 3200, such as a push-button or a sliding latch. This ensures that the lid door 3200 remains closed during transport or when the dispenser is not in use, providing an extra layer of protection against spills or contamination.

In the preferred embodiment, the materials used for the lid catch 2100 and lid overhang 3100 are chosen for their durability and compatibility with the rest of the dispenser. They must be able to withstand the repeated stress of opening and closing without degrading over time. The lid catch 2100 and lid overhang 3100 are in the preferred embodiment made from the same material as the main body 2000 and lid 3000, such as polypropylene, to ensure uniformity in the physical properties and behavior of the components.

The preferred embodiment of the dispenser features a lid door 3200 designed to create an airtight seal over the apertures 3050 of the lid 3000, ensuring the contents remain moist and uncontaminated when not in use. This lid door 3200 is precisely engineered to fit within an area, optionally a recessed area, upon the superior aspect of the lid 3000. In the preferred embodiment, the lid door 3200 provides a flush and seamless appearance when closed over the apertures 3050 of the lid 3000. In the preferred embodiment, the recess associated with the recessed area not only enhances the aesthetic appeal of the dispenser but also serves to protect the lid door 3200 from accidental opening.

On one side of the lid door 3200, a lid door hinge 3290 is integrated to facilitate its opening and closing motion. This lid door hinge 3290 is carefully designed to be both robust and discreet, allowing the lid door 3200 to pivot smoothly without detracting from the overall design. The lid door hinge 3290 in the preferred embodiment comprises a living hinge, molded as part of the lid door 3200 and the lid 3000 itself. In an alternative embodiment, the lid door hinge 3290 comprises a separate component made from a durable material such as stainless steel or reinforced plastic, depending on the desired durability and manufacturing considerations.

Figure 4B:
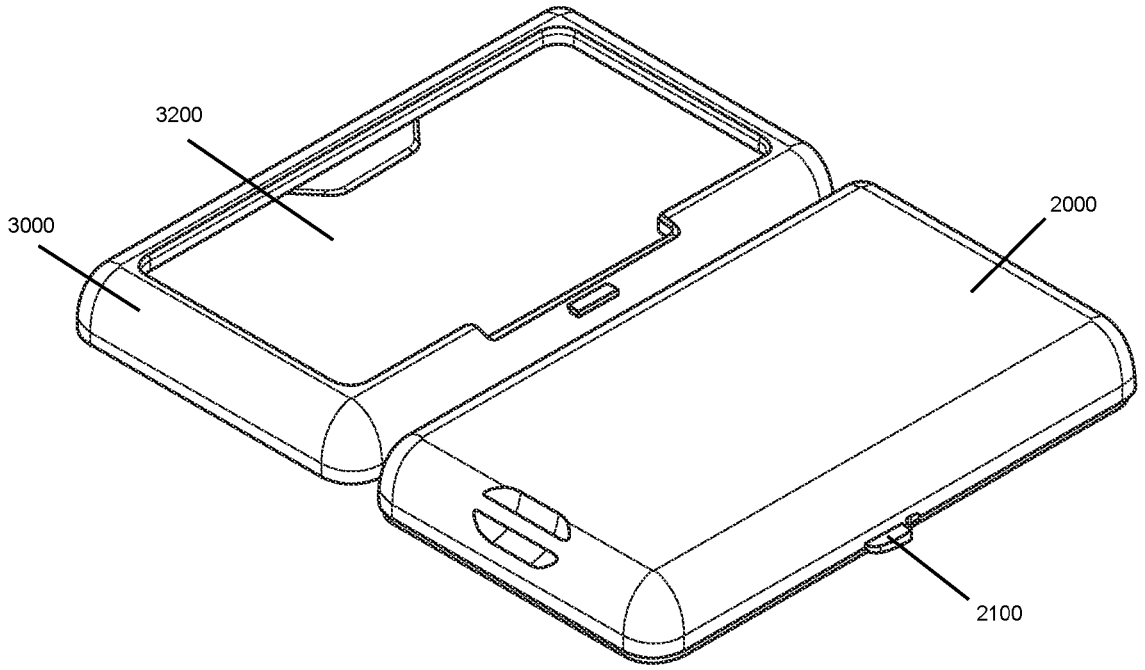
FIG. 4*b* depicts a perspective view of an embodiment of the wipe dispenser with the lid door in the closed position.
Figure 5A:
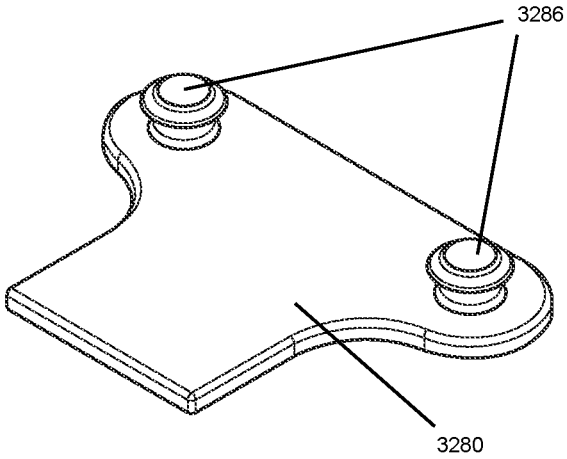
FIG. 5*a* depicts a perspective view of a lid spring mechanism in an embodiment.
Figure 5B:
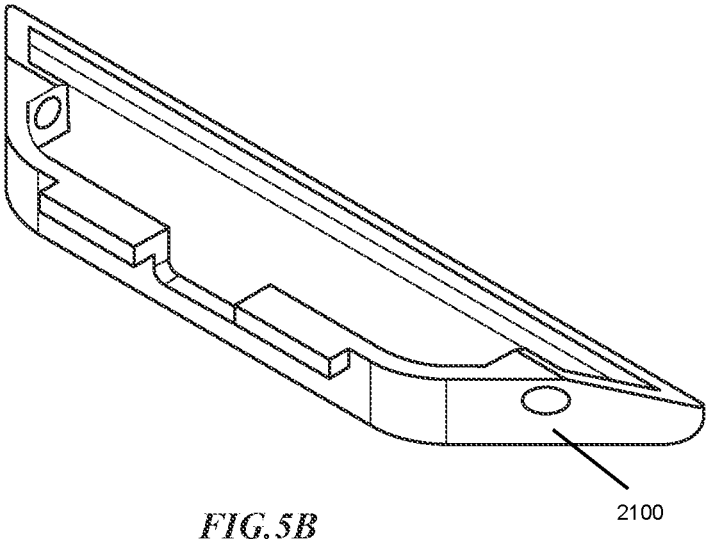
FIG. 5*b* depicts a perspective view of a lid catch mechanism in an embodiment.
Figure 5C:
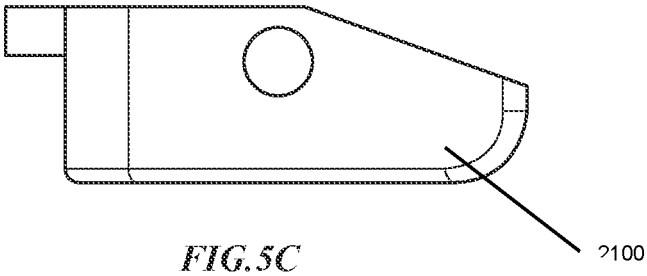
FIG. 5*c* depicts a side view of a lid catch mechanism in an embodiment.

To retain the lid door 3200 in the closed position as depicted in FIG. 4*b*, a mechanism is incorporated that securely locks the door against the lid 3000. This could be a snap-fit feature, where a protruding tab on the lid door 3200 clicks into a corresponding notch or depression in the lid 3000. Alternatively, a magnetic closure could be employed, with magnets embedded in the lid door 3200 and the lid 3000, providing a silent and smooth sealing action. For added security, a small latch or sliding lock could also be used, requiring a simple manual operation to release the lid door 3200 when access to the wipes is needed.

The materials chosen for the lid door 3200 and its sealing mechanism are selected for their compatibility with the rest of the dispenser, ensuring that they provide an effective airtight seal while also matching the durability and resistance to environmental factors. The design of the lid door 3200, its lid door hinge 3290, and the lid door retention mechanism are all optimized to ensure that the dispenser is both functional and user-friendly, providing a reliable seal with the convenience of easy access.

In the preferred embodiment, a lid spring mechanism 3280 is incorporated on the same side as the lid door hinge 3290. This lid spring mechanism 3280 is composed of silicone rubber in its preferred embodiment, a material chosen for its resilience and ability to exert consistent force over many cycles of use. In the preferred embodiment, the lid spring mechanism 3280 comprises spring attachment protrusions 3286 enabling the affixation of the lid spring mechanism 3280 to the lid 3000 by placement through the spring attachment points 3285 incorporated within the lid 3000. The lid spring mechanism 3280 is strategically positioned to apply a gentle yet firm force against an inferior aspect of lid door 3200 from the lid 3000. This force is calibrated to keep the lid door 3200 dispenser in its opened configuration, facilitating easy access to the contents without the need for the user to manually hold the lid door 3200 open.

When the lid door 3200 is closed upon the lid 3000, the lid spring mechanism 3280 expands or extends, storing potential energy as the lid door 3200 closes upon the lid 3000. Once the user releases the lid door 3200 retention mechanism, the stored energy in the lid spring mechanism 3280 acts to push the lid door 3200 back towards the open position away from the lid 3000. This feature is particularly useful in situations where the user requires both hands to retrieve the towelettes, allowing for a more efficient and convenient operation.

The placement of lid spring mechanism 3280 is intentionally chosen in association with the preferred embodiment. The present inventor has recognized that the lid spring mechanism 3280 must be located in such a way that it does not impede the closing motion or interfere with the lid door hinge's 3290 function. The lid spring mechanism 3280 is designed to be unobtrusive and to complement the overall design of the dispenser. When the lid door 3200 is closed, the tendency of the lid spring mechanism 3280 to retain the lid door 3200 in an open position is neutralized by the retention of the lid door 3200 within the lid 3000.

The choice of silicone rubber for the lid spring mechanism 3280 is due to several advantageous properties of the material. Silicone rubber maintains its elasticity over a wide range of temperatures and does not degrade significantly over time, ensuring long-term reliability. It is also resistant to moisture and many chemicals, making it suitable for use in environments where the dispenser may be exposed to various substances. Furthermore, silicone rubber is a non-toxic and hypoallergenic material, which is an important consideration for products that may come into contact with skin or be used in sensitive environments.

In an alternative embodiments of the dispenser, alternative lid spring mechanisms may be utilized. In one embodiment, a metal coil spring is utilized as the lid spring mechanism, positioned on the same side as the lid door hinge 3290 to facilitate the lid door 3200's opening. When the lid door 3200 is closed, the spring is compressed, storing potential energy. Upon release of the snap-fit mechanism, the stored energy in the spring is released, gently pushing the lid door 3200 open. This metal coil spring is made from corrosion-resistant stainless steel, ensuring longevity and consistent performance even in humid environments where the dispenser may be used.

In another alternative embodiment, a torsion spring is integrated into the lid door hinge 3290 assembly. This spring is designed to apply a rotational force to the lid when it moves towards the closed position. As the lid door 3200 is opened, the torsion spring is wound tightly, storing energy that is subsequently released to maintain the lid door 3200 in an open state. The torsion spring's force is finely tuned to provide just enough torque to keep the lid door 3200 open without making it difficult to close, ensuring a user-friendly experience.

In yet another alternative embodiment, a leaf spring is incorporated into the dispenser's structure. This spring, made from a thin strip of flexible, fatigue-resistant material such as spring steel or reinforced plastic, is affixed to the interior of the lid door 3200. As the lid door 3200 closes, the leaf spring flexes, creating a restoring force that pushes the lid door 3200 back into the open position once the catch mechanism is disengaged. The simplicity of the leaf spring design allows for a minimalistic approach while still providing the necessary functionality.

Figure 3A:
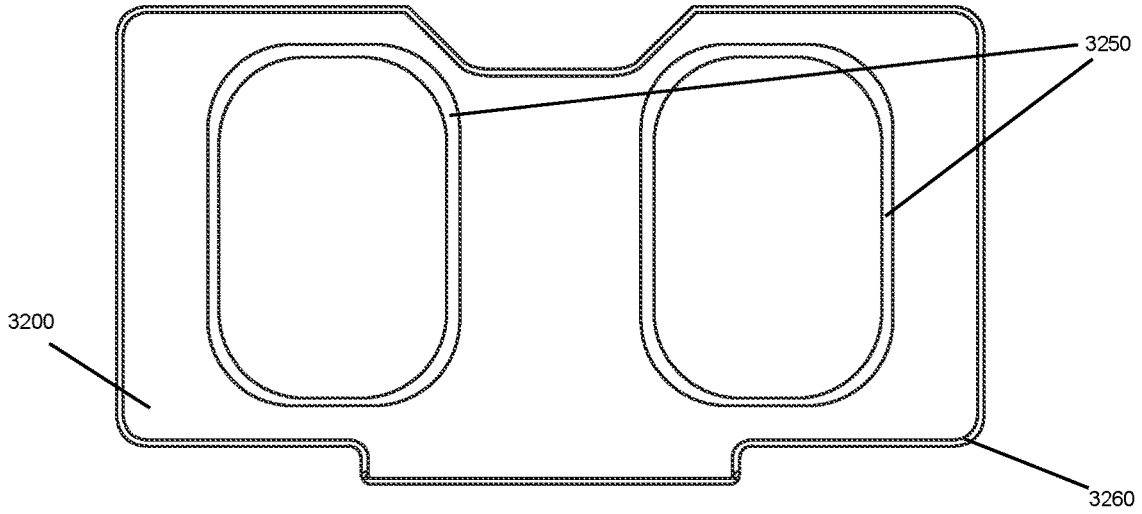
FIG. 3*a* depicts a bottom up view of the lid door in an embodiment.
Figure 3B:
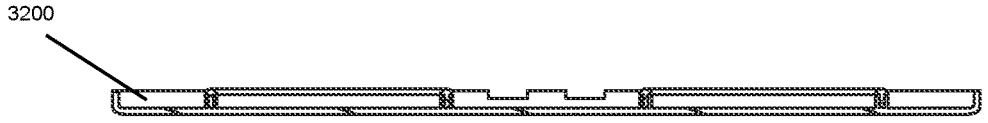
FIG. 3*b* depicts a side view of the lid door in an embodiment.

In an embodiment, the lid door 3200 comprises aspects intended to maintain the freshness and integrity of the contents within the dispenser. On the inferior aspect of the lid door 3200 in an embodiment, the lid door 3200 features a specially designed protrusion or gasket 3250, as depicted in FIG. 3*a*, that corresponds precisely to the dimensions of the apertures 3050 on the lid. As such, the lid door 3200 creates an airtight seal when the lid door 3200 is in the closed position, as depicted in FIG. 4*b*. The protrusion or gasket 3250, made from a soft, pliable material such as silicone or rubber, compresses against the edges of the apertures 3050 of the lid, conforming to any minor variances in the surface to prevent the ingress of air and contaminants. The material's inherent flexibility allows it to adapt to the aperture's 3050 shape, ensuring that the seal is maintained even with repeated use. This sealing mechanism is essential for preventing the drying out of premoistened wipes and for keeping dry wipes free from moisture, thus preserving the quality and effectiveness of the dispenser's contents.

In addition to the sealing mechanism on the inferior aspect of the lid door 3200, the preferred embodiment of the dispenser further comprises a sealing system along the outer edges of the lid door 3200 to reinforce the airtight seal when the lid door 3200 is closed within the recess of the lid 3000. This system includes a continuous gasket or seal that runs along the perimeter 3260 of the lid door 3200, designed to match the contours of the recess. Upon closing, the gasket compresses against the recessed edges, filling any gaps that could potentially allow air to enter. The gasket material is selected for its durability and resistance to compression set, ensuring that it maintains its shape and sealing properties over time. In various embodiments, this material could consist of a silicone, foam, or rubber compound known for its excellent sealing characteristics. The combination of the gasket on the outer edges and the protrusion corresponding to the apertures 3050 ensures an airtight seal, safeguarding the contents from environmental factors and maintaining the desired moisture levels within the dispenser.

In its preferred embodiment, the dispenser's design extends the concept of airtight sealing to the interface between the lid 3000 and the main body 2000, ensuring that when the lid 3000 is in the closed position upon the main body 2000, the contents are fully protected. This is achieved through the implementation of sealing components that mirror the effectiveness of the lid door 3200's gasket aspects. A continuous, resilient gasket is strategically positioned around the periphery of the main body 2000's opening to its interior volume, where the lid 3000 comes to rest when closed. This gasket is engineered to compress against the lid 3000, creating a tight seal that prevents air exchange and moisture loss. The material used for this gasket is chosen for its elastic properties and resistance to wear, ensuring that it can withstand the repeated actions of opening and closing the lid 3000 without losing its sealing capability. The precision with which this gasket aligns with the lid 3000 ensures that, upon closure, an airtight seal is formed, preserving the freshness of the dispenser's contents and providing an additional layer of protection against external contaminants.

In the preferred embodiment of the dispenser, the design integrates a tethering mechanism 1001 that facilitates secure and convenient attachment to a variety of fixtures, enhancing the dispenser's stability and accessibility across diverse settings. The tethering mechanism 1001 itself is constructed to be both sturdy and flexible, ensuring a reliable connection that can accommodate movement. Notably, the tether attachment point 1002 for the tethering mechanism 1001 in the preferred embodiment is an integral part of the main body 2000, which can be formed during the injection molding process that creates the dispenser. This integrated anchoring point is designed to be robust, with structural reinforcements that are molded directly into the main body 2000, providing a strong and durable connection point for the tether without the need for additional assembly processes.

In various embodiments, the tethering mechanism 1001 may take on multiple forms and utilize different attachment mechanisms to suit specific user requirements and preferences. For instance, the tethering mechanism 1001 could be a strap with an adjustable buckle, allowing for length customization, or it could be a retractable cord that offers compact storage when not in use. The tethering mechanism 1001 could also feature a carabiner or clip at the end opposite the loop, providing a quick and easy way to attach and detach the dispenser from strollers, shopping carts, or car seats. In some embodiments, the tethering mechanism 1001 could be made from materials like leather, reinforced fabric, or elastic materials, each offering unique aesthetic and functional properties.

The tethering mechanism's 1001 reinforced loop, which connects to the main body 2000 at the tether attachment point 1002, can be produced using various methods, including but not limited to high-strength bonding, ultrasonic welding, or the use of resilient fasteners such as rivets or screws. These fasteners would engage with the tether attachment point 1002, which is strategically designed to accommodate such attachments and to endure the rigors of daily use. The versatility in the design of the tethering mechanism 1001 allows for a range of options, providing users with the flexibility to choose a tethering solution that best fits their lifestyle and the demands of their environment.

In addition to the tether attachment point 1002, the tethering mechanism 1001 may also include an adjustable clasp or buckle, allowing the length of the tethering mechanism 1001 to be modified according to the user's needs. This adjustability ensures that the dispenser can be tethered at an optimal distance from the tether attachment point 1002, whether it be a stroller, a car headrest, or a bathroom fixture. The clasp or buckle of the tethering mechanism 1001 in an embodiment is constructed from a material that is both lightweight and strong, such as high-grade plastic or metal, to provide a secure hold without adding unnecessary weight to the dispenser.

Furthermore, the tethering mechanism 1001 itself is made from a material that balances durability with flexibility, such as a woven nylon or polyester strap, which is resistant to tearing and abrasion. The surface of the tethering mechanism 1001 may be treated with a water-resistant coating to prevent moisture absorption and to facilitate easy cleaning. The combination of a strong tether attachment point 1002, an adjustable clasp associated with the tethering mechanism 1001, and a durable tether material ensures that the dispenser remains conveniently within reach while preventing it from being dropped or lost during transport or use.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

I claim:

1. A dispenser for wipes comprising:

a main body defining an interior volume divided by an interior wall into at least two separate sealable compartments, each compartment configured to receive a package of towelettes, wherein the interior wall extends from a base of the main body to an underside of a lid to prevent cross-contamination between compartments;

the lid comprising two distinct apertures, each aperture providing access to a respective compartment, each aperture having an ovular shape;

a lid door pivotally connected to the lid via a lid door hinge, the lid door comprising: at least one silicone O-ring gasket positioned to correspond to dimensions of the apertures, the gasket configured to compress against edges of the apertures when the lid door is in a closed position to create an airtight seal;

a perimeter gasket extending along an outer edge of the lid door;

a lid spring mechanism composed of silicone rubber, positioned on a same side as the lid door hinge, the spring mechanism configured to:

store potential energy when the lid door closes upon the lid; and release the stored energy to push the lid door toward an open position when a lid catch mechanism is disengaged, enabling one-handed operation;

the lid catch mechanism on the main body configured to engage with a corresponding lid overhang on the lid to create a snap-fit closure; and a tether attachment point integrally formed with the main body, configured to receive a tethering mechanism.

2. The multi-compartment wipe dispenser of claim 1, wherein the lid, main body, and lid door are constructed from polypropylene and manufactured via injection molding.

3. The multi-compartment wipe dispenser of claim 1, wherein the silicone O-ring gasket is composed of soft, pliable silicone configured to conform to variances in surface of the apertures.

4. The multi-compartment wipe dispenser of claim 1, wherein the lid spring mechanism comprises spring attachment protrusions configured to engage with spring attachment points in the lid.

5. The multi-compartment wipe dispenser of claim 1, wherein the two compartments are configured to store different types of wipes comprising a soap wipe and a water wipe.

6. The multi-compartment wipe dispenser of claim 1, wherein the lid catch and lid overhang together form a snap-fit mechanism with a flexible tab that snaps into a corresponding slot.

7. The multi-compartment wipe dispenser of claim 1, wherein the tethering mechanism comprises an adjustable strap with a carabiner or clip for attachment to a stroller, carrier, or shopping cart.

* * * * *